United States Patent [19]

Davis et al.

[11] 4,235,377

[45] Nov. 25, 1980

[54] PORTABLE PAINT SPRAYING DEVICE

[75] Inventors: Howard C. Davis; Donald L. Cooper, both of Columbus, Ohio

[73] Assignee: The Wooster Brush Company, Wooster, Ohio

[21] Appl. No.: 964,449

[22] Filed: Nov. 29, 1978

Related U.S. Application Data

[63] Continuation-in-part of Ser. No. 740,109, Nov. 9, 1976, abandoned.

[51] Int. Cl.[3] ..... B05B 3/08

[52] U.S. Cl. ..... 239/215; 74/25; 74/117; 92/13.7; 239/222; 239/224; 239/332

[58] Field of Search ..... 92/13.7; 239/214, 215, 239/222, 222.11, 223, 224, 288–288.5, 332, 333; 74/25, 117, 568 R

[56] References Cited

U.S. PATENT DOCUMENTS

| | | | |
|---|---|---|---|
| 864,742 | 8/1907 | Jirotka | 239/223 X |
| 2,084,621 | 6/1937 | Norris | 239/222 |
| 2,257,807 | 10/1941 | Morse | 239/215 |
| 3,312,170 | 4/1967 | Brailsford | 92/13.7 X |
| 3,455,507 | 7/1969 | Ryder et al. | 239/215 |
| 3,901,449 | 8/1975 | Bochmann | 239/332 |

*Primary Examiner*—Andres Kashnikow
*Attorney, Agent, or Firm*—Maky, Renner, Otto & Boisselle

[57] ABSTRACT

A portable pump spraying device includes a container for the liquid to be sprayed, a housing positioned above the container having a spraying chamber, a pumping unit to elevate the liquid to the spraying chamber, and a rotating disc in the spraying chamber to attenuate and impel the liquid by centrifugal force through an egress port in the housing. Interceptor baffles within the spraying chamber finely trim the liquid spray as it leaves the egress port and direct the excess liquid back to a reservoir for recirculation. The pumping unit includes a rod that is reciprocated by an eccentric on the rotating shaft on which the disc is mounted. The rod acts as a piston which on its suction stroke withdraws liquid from the container and on its compression stroke discharges the withdrawn liquid and forces it through a nozzle onto the disc in the spraying chamber. In one form of the invention, the volume of liquid being pumped by the pumping unit may be varied for varying the amount of liquid being sprayed without varying the speed of the pump drive motor and thus the speed of the disc driven thereby.

25 Claims, 11 Drawing Figures

PORTABLE PAINT SPRAYING DEVICE

CROSS-REFERENCE TO RELATED APPLICATIONS

This application is a continuation-in-part of United States application Ser. No. 740,109, filed Nov. 9, 1976 now abandoned.

BACKGROUND OF THE INVENTION

The present invention relates in general to an airless type portable paint sprayer including in particular a rotatable vertically oriented attenuator disc in combination with a commonly driven pump unit.

Examples of portable airless spraying devices may be found in U.S. Pat. Nos. 3,125,296 and 3,197,142 in which a horizontally oriented rotating disc is used centrifugally to impel paint conveyed thereto through a slot in the housing. Such spray devices are of a relatively complicated construction, and fairly difficult to clean, and are not as compact and light as desired for easy hand use.

SUMMARY OF THE INVENTION

With the foregoing in mind, it is a principal object of this invention to provide a relatively low cost and lightweight hand held portable spraying unit which is easily cleaned and may be effectively used for spraying a variety of paints. The device generally includes a vertically oriented rotating attenuator disc that cooperates with a commonly driven pump unit. Although generally vertically oriented discs have previously been used in different types of high pressure sprayers, as shown for example in U.S. Pat. Nos. 3,055,592 and 1,908,230, the use of a vertical rotating attenuator disc in the device of the present invention provides, for the first time, distinct advantages to the user of a portable spray unit in terms of spray pattern, cleaning accessibility, and ease of portability and compactness. The attenuator disc is located within a spraying chamber having an egress port through which the paint is impelled by centrifugal force. Interceptor baffles within the spraying chamber finely trim the paint spray as it leaves the egress port and direct the excess liquid back to a reservoir for recirculation.

The liquid pumping unit is desirably driven by the same motor that drives the attenuator disc. In one form of the invention, the volume of liquid being pumped by the pumping unit may be varied for varying the amount of liquid being sprayed without varying the speed of the pump drive motor and attenuator disc driven thereby. The interrelationship of the pumping, attenuating and spraying of the liquid provides controlled operation for different types of paints or other liquids. The liquid follows a generally straight through flow path of limited resistance through the device, thereby correspondingly reducing the power required to pump the liquid, and the pump design is such that there is a relatively sharp cutoff of the spray upon deenergizing the pump motor without the need for additional more expensive parts.

Other objects and advantages of the present invention will become apparent as the following description proceeds.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but several of the various ways in which the principles of the invention may be employed.

DESCRIPTION OF THE PREFERRED EMBODIMENTS

Figure 1:
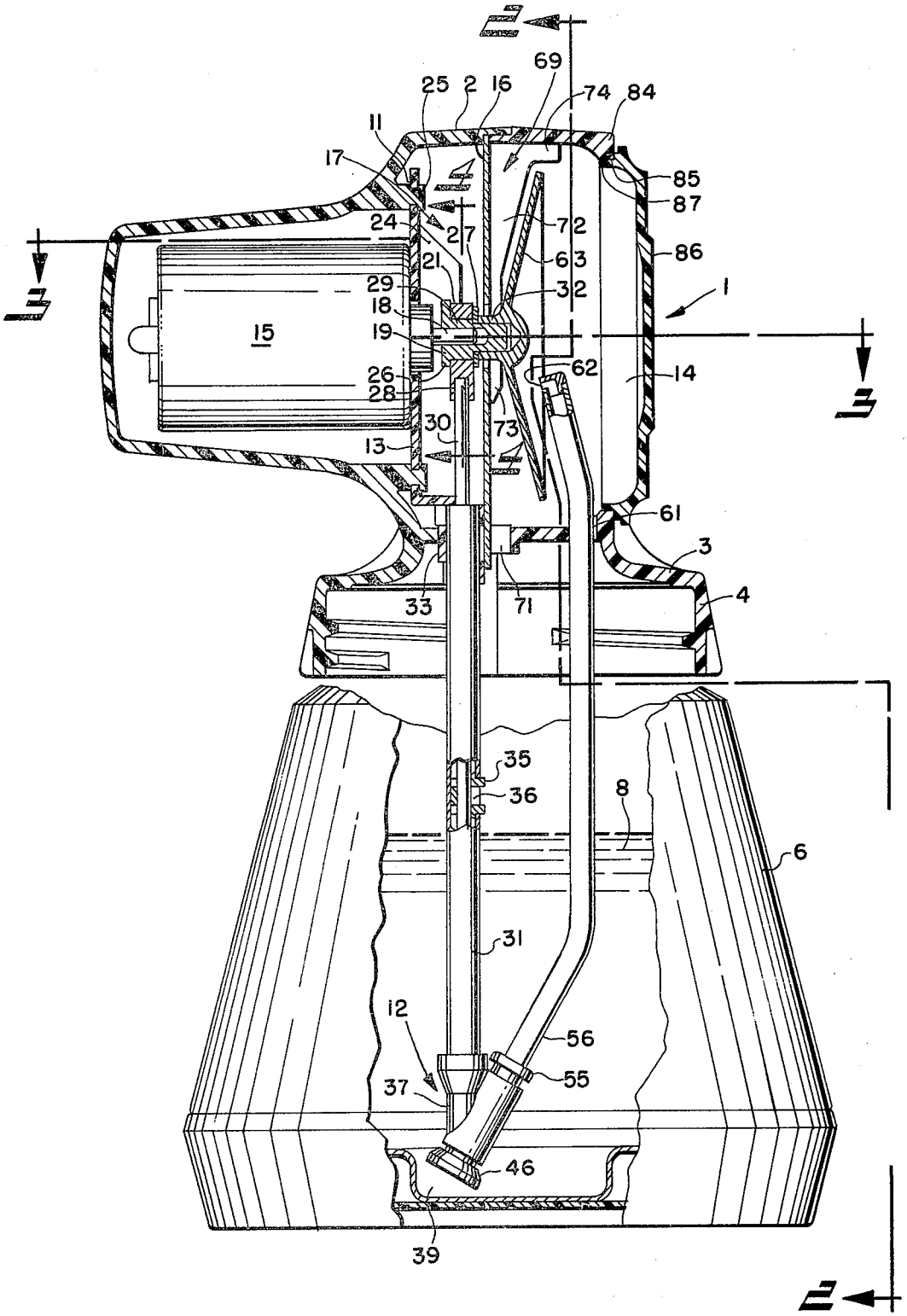
FIG. 1 is a fragmentary transverse section through a preferred form of pump spraying device in accordance with the present invention, with part of the container and housing being broken away to illustrate the construction thereof.

Referring now in detail to the drawing, the portable pump spraying device, indicated generally at 1, includes a housing 2 which may be made of a suitable plastic or other suitable material desirably having a cover or lid 3 integral therewith. The cover 3 is provided with an internally threaded peripheral skirt 4 for removable connection to the externally threaded throat 5 on container 6. With the housing 2 removed from the container, the paint or other liquid 8 to be sprayed may be poured into the container through the throat 5 until the desired liquid level is reached. The housing 2 and cover 3 are then placed over the container 6 and screwed thereon in preparation for use of the device by selective actuation of a trigger 9 on handle 10 in a manner to be subsequently described. The trigger 9 controls operation of a pumping unit, indicated generally at 12, which lifts the contained liquid 8 into the spray chamber 14 of the housing 2 for discharge therefrom, as described in more detail below.

The pumping unit 12 is driven by an electric motor 15 that is selectively energized by actuation of trigger 9. Power for the motor 15 may be supplied by a rechargeable battery in the handle 10, or by electric connection to a conventional external power source as desired. The motor 15 is horizontally supported in a drive chamber 17 within the housing 2 by a mounting plate 13 which may be made of a suitable plastic material and secured in place as by providing apertures 11 therein for attachment to mounting posts 25 on the housing. A vertically extending partition 16 separates the drive chamber 17 from the spray chamber 14. The output shaft 18 of motor 15 has an annular eccentric cam 19 eccentrically mounted thereon in the drive chamber 17 for concurrent rotation therewith.

Figure 4:
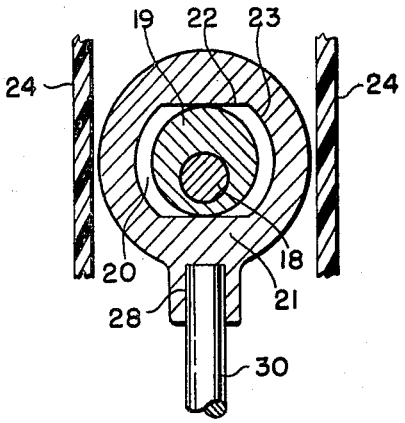
FIG. 4 is a sectional detail taken along line 4—4 in FIG. 1 to illustrate the eccentric drive for the pump piston rod.

As best shown in FIG. 4, the eccentrically mounted cam 19 is received in a horizontal slot 20 in a connector member 21. Such slot 20 is desirably rectangular in shape with straight upper and lower sides 22 and curved ends 23. The width of the slot 20 is approximately equal to the cam diameter and the length is sufficiently greater than the cam diameter as shown to permit the eccentric cam 19 to rotate therein, with the sides 22 of slot 20 following the cam surface for effecting vertical reciprocal movement of the connector member 21 while providing sufficient clearance between the cam 19 and curved ends 23 to preclude side to side movement. Substantially only vertical movement of the connector member 21 is assured by providing a pair of spaced apart, vertically oriented fixed guides 24 on the mounting plate 13 adjacent opposite sides of connector member 21 to confine the movement thereof to a reciprocal vertical path. The connector member 21 may also be longitudinally confined between a radially outwardly extending flange 26 on one end of cam 19 and an annular washer 27 spaced therefrom. The washer 27 is located on the cam 19 by a shoulder 29 thereon and retained in place by the spinner disc hub 32.

The bottom of the connector member 21 is provided with an opening 28 for receipt of the top end of the vertically oriented pump rod 30, which is pinned or otherwise suitably secured thereto. Vertical reciprocal movement of connector member 21 thus causes vertical reciprocal movement of pump rod 30. The rod 30 is reciprocably received in a rigid protective tube 31 of aluminum or the like which may be fixedly mounted to the housing 2 by a finger-like extension 33 on the mounting plate 13. The protective tube 31 has an intermediate bushing 35 received and held therein slidingly to engage the pump rod 30 for vertical guidance of the same to support the rod 30 against bending. The bushing 35 may be slotted and have the configuration shown in FIG. 1 to permit it to be snap-fitted in place through a slot 36 in the tube 31. The bottom of protective tube 31 is received in and connected to a pump housing 37 which may be disposed in a well 39 at the bottom of container 6, with the lower end of pump rod 30 slidably received in the pump cylinder 38 in the pump housing 37 (see FIG. 5).

The pump cylinder 38 intersects and is in fluid communication with an enlarged bottom end 40 of a stepped bore 42 that also defines a central passage 43 and an enlarged top end 44. An inlet fitting 46 is received in and suitable connected to the enlarged bottom end 40 of bore 42, with the passage 47 therethrough normally being closed by an inlet ball check valve 50 resting against seat 51. An inlet screen 48 covers the inlet opening 47 to keep out solid or semi-solid particles. A second outlet ball check valve 52 is positioned in the enlarged top end 44 of bore 42, with such ball normally resting against seat 53 to close off the upper end of passage 43. An outlet fitting 55 is received in and threadedly connected to enlarged top end 44 of bore 42, such outlet fitting 55 receiving the lower end of a delivery tube 56. A suitable bushing 58 within the outlet fitting 55 limits the amount of movement of the ball check valve 52 away from its seat.

Figure 5:
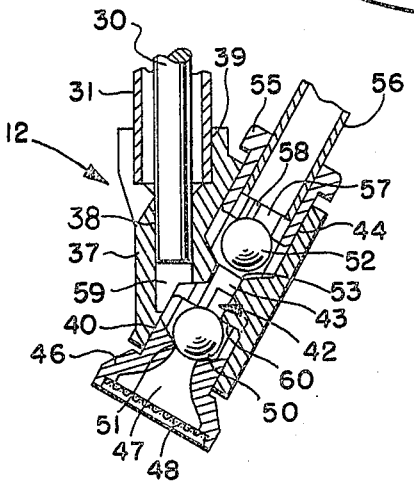
FIG. 5 is a sectional detail of the variable volume pumping chamber and the valving arrangement therefor shown during the compression stroke of the pump rod.

On the upward or suction stroke of rod 30, the inlet ball valve 50 is drawn off seat 51 to open passage 47 through inlet fitting 46. Movement of the ball 50 away from its seat is limited by the ball 50 engaging a shoulder stop 60 in the stepped bore 42. Such suction stroke of rod 30 also results in the ball 52 of the outlet check valve being drawn against its seat 53. On the downward or compression stroke of rod 30 as illustrated in FIG. 5, the inlet ball valve 50 is forced closed against its seat 51 and the outlet ball valve 52 is forced open against bushing 58 which permits the liquid from pumping chamber 59 to pass therethrough into the delivery tube 56, while controlling the magnitude of movement of ball 52 away from its seat 53.

The delivery tube 56 extends generally vertically upwardly and passes through an aperture 61 in the housing lid 3 and into the spraying chamber 14 of housing 2. The tube 56 is provided at its upper end with a nozzle 62 for directing the pumped liquid flowing therethrough against a central area of a spinner disc 63 suitably mounted on the output shaft 18 of motor 15. The bore 42 through pump housing 37 and delivery tube 56 define the flow path for the liquid from the container to the spray chamber 14, and such flow path is generally straight to minimize power requirements and facilitate pumping of liquids of different types and viscosities.

Figure 6:
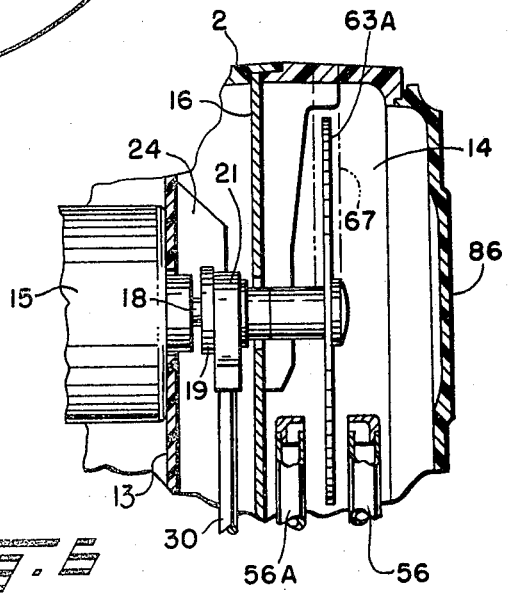
FIG. 6 is a fragmentary transverse section through a modified form of pump spraying device in accordance with the present invention.

The spinner disc 63 is preferably conically shaped as illustrated and extends radially and axially forwardly of the motor output shaft 18, such orientation improving the cleaning and maintenance of the device as discussed in more detail below. While a single delivery tube 56 is sufficient to deliver liquid to the spinner disc, it will be appreciated that more than one tube may be utilized for increased output of the device, and the liquid may also be delivered by two tubes 56 and 56A against the opposite sides of a flat disc 63A for increased capacity, as illustrated in FIG. 6.

Figure 2:
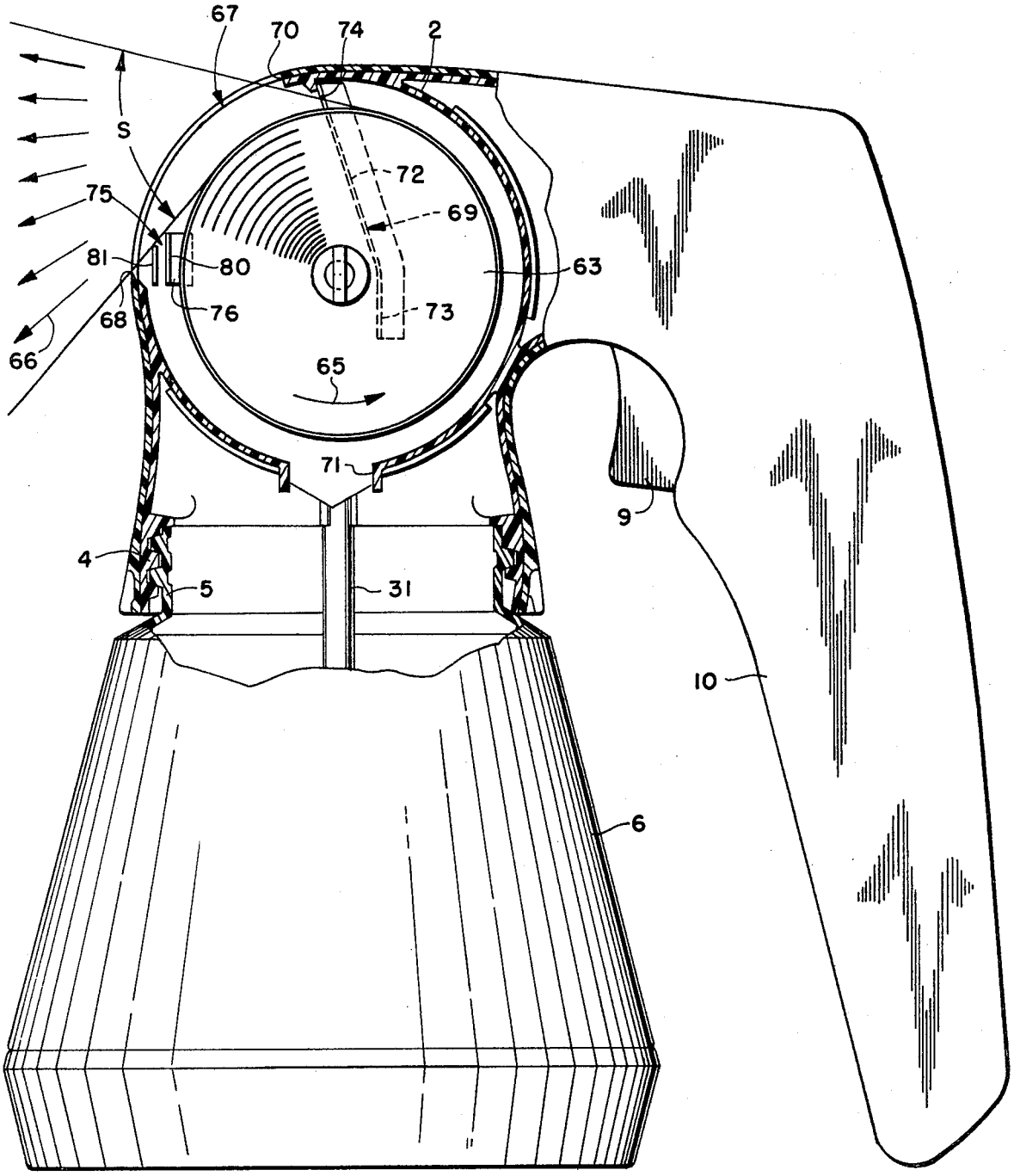
FIG. 2 is a fragmentary longitudinal section through the pump spraying device if FIG. 1 taken generally along line 2—2 to illustrate the egress port and interceptor baffles cooperating therewith.

Rotation of the spinner disc 63 in the counterclockwise direction indicated by arrow 65 in FIG. 2 will attenuate or atomize the liquid directed thereagainst by the nozzle 62 and will impel the same radially outwardly by centrifugal force and slightly forwardly of the disc face because of the conical shape thereof. Such atomized liquid will pass as a spray 66 through a radial elongated arcuate egress slot 67 in the housing 2 located radially outwardly of the outer periphery of the spinner disc. Of course, it will be appreciated that only a small portion of the liquid delivered to the spray chamber 14 is slung or impelled through slot 67, depending on the size and location of the slot and interceptors to be subsequently described. The trailing edge 68 of the slot 67 is preferably beveled as shown in FIG. 2.

The excess liquid is returned to container 6 for recirculation by a system of interceptors and partitions to keep such excess liquid off the disc and off the drive components. More specifically, such system of interceptors desirably includes a baffle 69 mounted on a partition 16 behind disc 63 adjacent the leading edge 70 of slot 67. The baffle 69 shown has a generally fan shaped, angularly disposed upper leg portion 72 that collects the excess liquid in the upper portion of the spray chamber 14 behind disc 60 and directs the same to the vertically oriented leg 73 that extends around the drive shaft and downwardly therebelow as best shown in FIG. 2. Such excess liquid drops from leg 73 to the bottom of the housing 2, which has an aperture 71 therein to return such excess liquid to the container. The baffle 69 thus keeps the excess liquid off the back side of disc 63 and off the drive shaft during recirculation. The partition 16 similarly returns the excess liquid to the container 6 and keeps such liquid out of contact with the motor and eccentric drive.

At the uppermost end of the baffle 69 is a transversely extending interceptor portion 74 which projects from one side of the disc 63 to the other adjacent the leading edge 70 of the slot 67 as shown in FIG. 1 to intercept the liquid that is slung off the disc outwardly of that point for trimming the upper edge of the spray fan.

Figure 3:
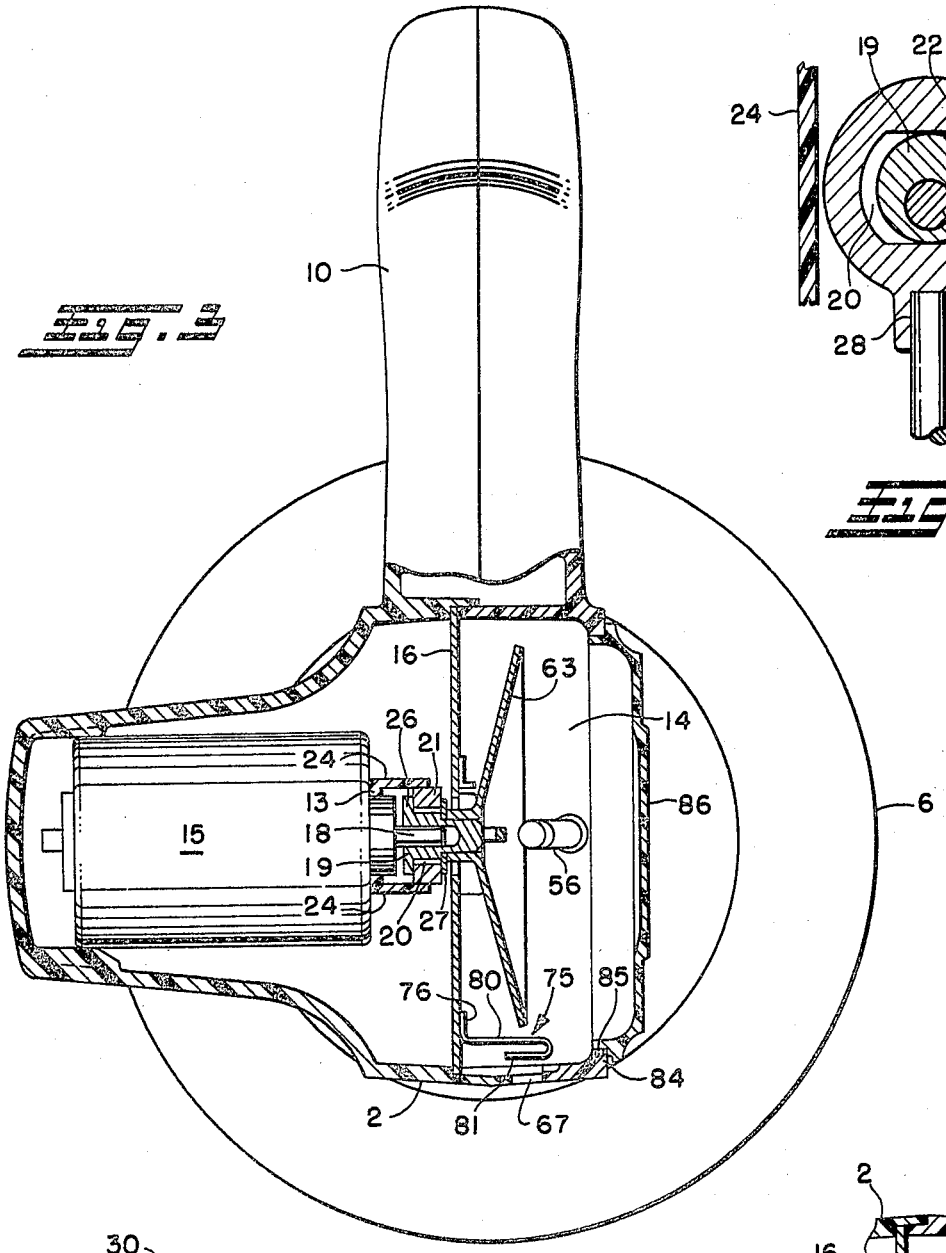
FIG. 3 is a sectional plan view through the pump spraying device taken along line 3—3 in FIG. 1.

A second U-shape baffle 75 is also desirably provided adjacent the trailing edge 68 of slot 67, and is shown mounted by flange 76 to partition 16. Both legs 80 and 81 of the U-shape baffle 75 extend slightly above and below the trailing edge 68 of the slot 67 and across the peripheral edge of the disc 63 as shown in FIGS. 2 and 3 to trim the lower edge of the spray fan and collect excess attenuated liquid and direct the same toward the aperture 71 in the bottom of housing 2 for recirculation. The upper edge of the forwardmost leg 81 is positioned slightly below the upper edge of the leg 80 to finely trim the lower edge of the spray fan previously cut by the first leg 80. Such U-shape baffle 75, like the baffle 69, thus confines the excess liquid to the housing 2 to avoid external dripping while directing the same to aperture 71 for recirculation in a path avoiding spinner disc 63. The remaining excess attenuated liquid is well in front of disc 63 and collects on the arcuate wall of housing 2 for return to the container as described above.

In the preferred form shown, the interceptor portions 74, 80 and 81 define a spray fan angle S of approximately 64° as shown in FIG. 2 for discharge of approximately 1/5 to 1/6 of the paint flung off the disc through the discharge slot 67. As apparent, the slot size and orientation and location of interceptor portions may be varied within limits to vary the amount and direction of discharge of the liquid spray therefrom.

The vertical end wall 84 of the housing 2 is provided with an annular opening indicated generally at 85 and normally covered by an end closure cap 86 which may be snap-fitted into the opening and held in such position by annular shoulder 87 on such cap for ease of removal of the cap 86 to provide access to all the components in the housing 2 and particularly to the components in the spray chamber 14 for cleaning or maintenance as may be required. Similarly, the housing 2 may readily be removed from the container 6 by unscrewing the container from the cap 3 to expose the pumping unit for cleaning or maintenance.

Figure 7:
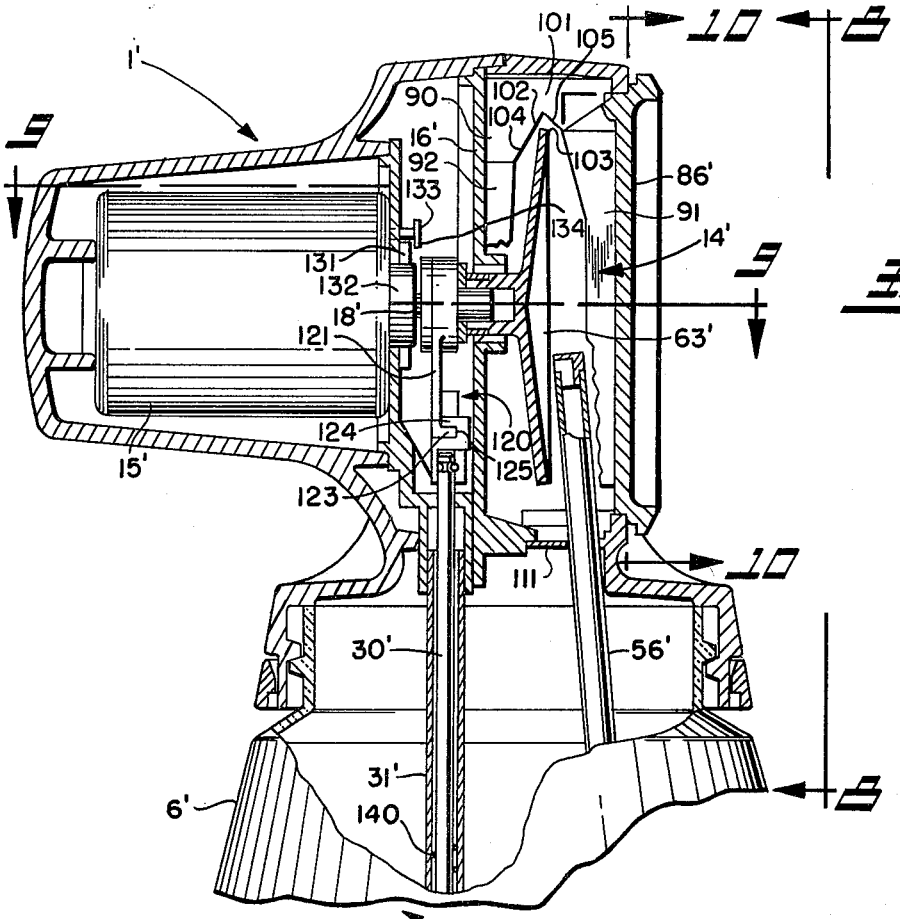
FIG. 7 is a fragmentary transverse section through still another pump spraying device embodiment in accordance with the present invention including a modified interceptor baffle arrangement which permits spraying at different angles without splatter, and includes provision for varying the volume of liquid being pumped by the pumping unit for varying the amount of liquid being sprayed without varying the speed of the pump drive motor and attenuator disc driven thereby.
Figure 8:
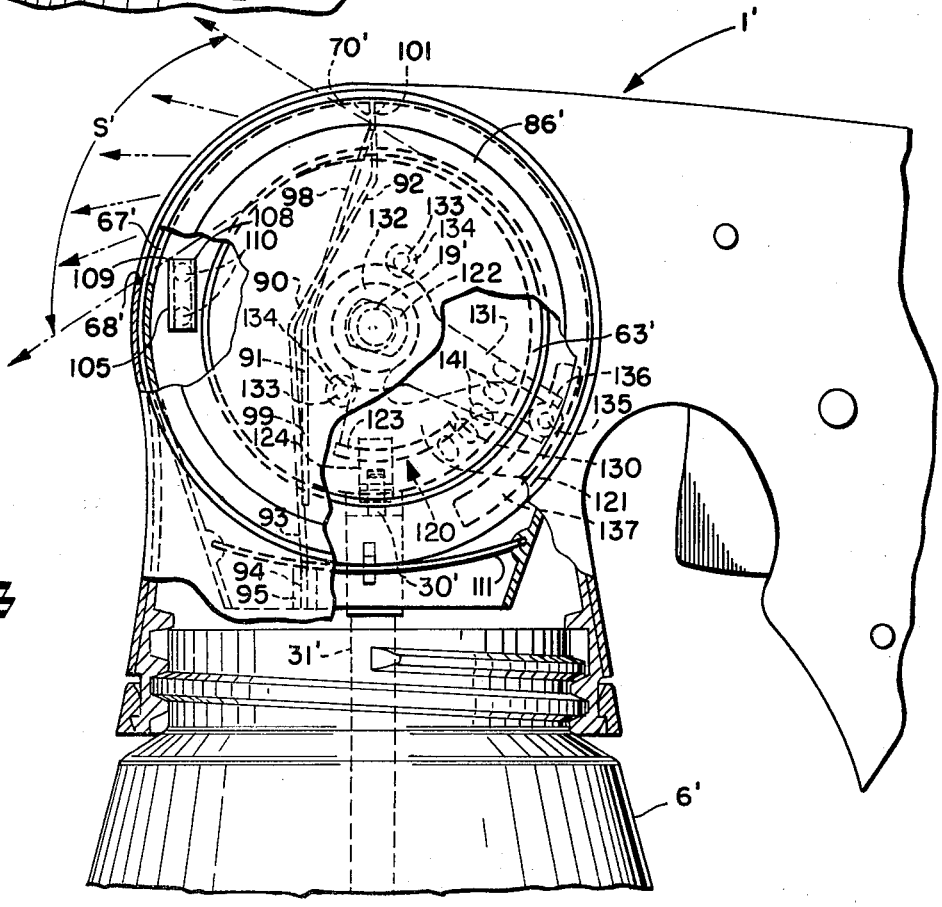
FIG. 8 is a partial side elevation view of the pump spraying device of FIG. 7 as generally seen from the plane of the line 8—8 with portions of the housing and spinner disc broken away better to show the interceptor baffle arrangement and mechanism for varying the length of the pump stroke for varying the amount of liquid being pumped.
Figure 9:
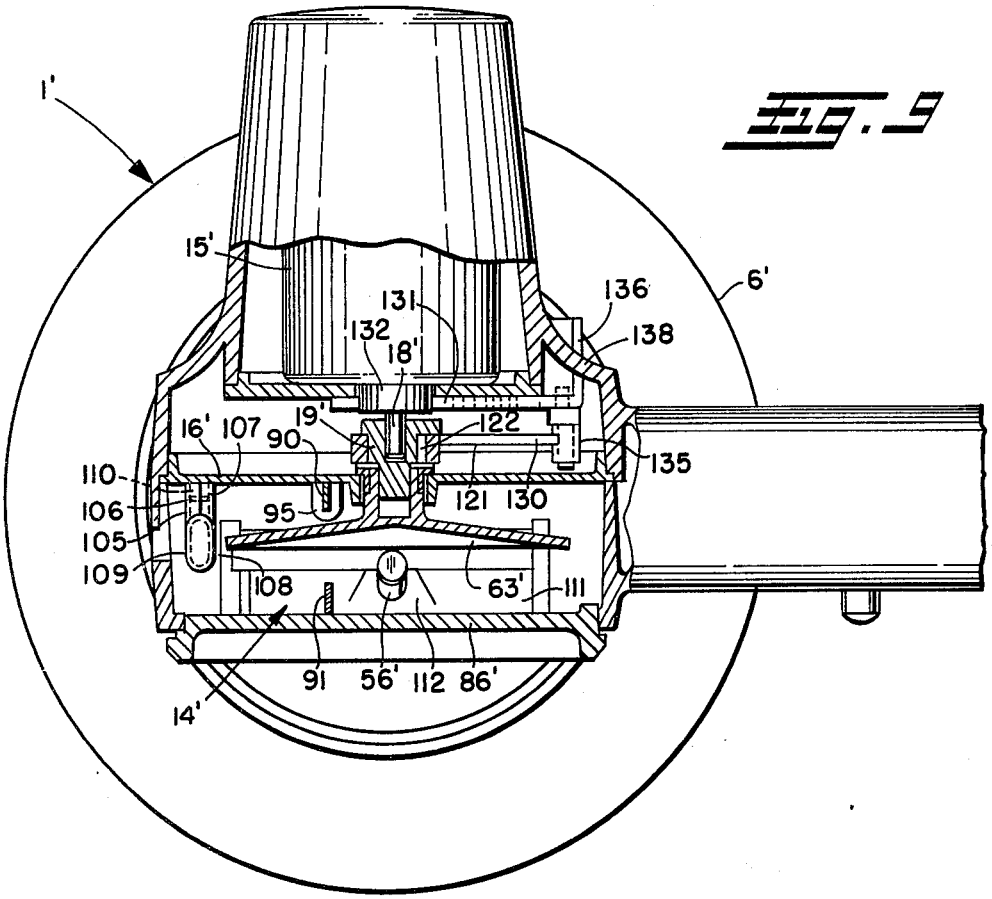
FIG. 9 is a fragmentary sectional plan view of the pump spraying device of FIG. 7, taken on the plane of the line 9—9 thereof.
Figure 10:
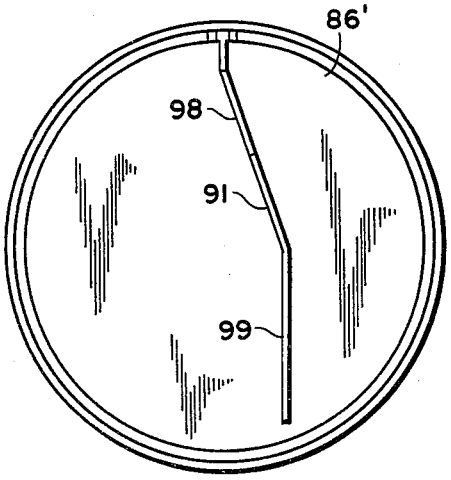
FIG. 10 is a vertical section through the pump spraying device of FIG. 7 taken on the plane of the line 10—10 thereof to show the inside of the end closure cap on which the front interceptor baffle is mounted.

In FIGS. 7–9 there is shown another preferred embodiment of portable pump spraying device 1' in accordance with this invention which is generally similar to the pump spraying device 1 previously described, and the same reference numerals followed by a prime symbol (') are used to designate like parts. However, as will be apparent, the system of interceptors which finely trims the liquid spray as it leaves the egress port 67' and directs the excess liquid back to the container 6' for recirculation is somewhat different. More specifically, such system of interceptors includes a pair of upper baffles 90, 91 disposed on opposite sides of the spinner disc 63'. One such baffle 90 is carried by the partition 16' behind disc 63' adjacent the leading edge 70' of the egress slot, and like the baffle 69 of the FIGS. 1–3 embodiment, is generally fan-shaped. However, the upper leg portion 92 thereof extends at an angle generally forwardly of the drive shaft 18', and the lower leg portion 93 extends generally vertically downwardly therefrom forwardly of such drive shaft with the lowermost portion 94 thereof suitably supported as by a bracket 95 adjacent the lower portion of the partition. The other baffle 91 adjacent the front side of the disc 63' is desirably suitably mounted on the end closure cap 86' as shown in FIGS. 7 and 10 to facilitate assembly and removal for cleaning and the like, and includes an upper leg portion 98 extending forwardly at an angle substantially corresponding to the angle of the upper leg portion 92 of the baffle 90, and a vertically oriented lower leg portion 99 extending downwardly therefrom forwardly of the drive shaft and downwardly therebelow (see FIG. 8).

The baffle 90 adjacent the back side of the spinner disc also desirably includes a transversely extending interceptor portion 101 at the uppermost end thereof which extends from one side of the disc to the other adjacent the leading edge 70' of the egress slot 67', with a V notch 102 therein into which the outer peripheral edge 103 of the spinner disc extends. The sides 104, 105 of the V notch are closely spaced from opposite sides of the spinner disc edge 103 to intercept the liquid that is flung off the disc along the top for trimming the upper edge of the spray fan and direct such excess liquid away from the disc as quickly as possible to eliminate puddling. Providing such a baffle arrangement on both sides of the spinner disc and across the upper edge thereof thus trims both the sides and upper edge of the spray fan S' and directs the excess liquid collected thereby back to the container for recirculation. Such a baffle arrangement also permits limited tilting of the pump spraying device either forward or back as well as to either side during use as may be required for spraying at different angles without splatter, the baffle arrangement preventing droplets of paint or other such liquid being sprayed from falling in globules on the spinner disc.

A lower interceptor baffle 105 arrangement is also desirably provided adjacent the lower edge 68' of the egress slot. Such baffle 105 may be of generally U-shape as before with both legs 106, 107 thereof extending slightly above and below the lower edge of the egress slot and across the peripheral edge of the spinner disc as shown to trim the lower edge of the spray fan and collect excess attenuated liquid and direct same to the container. Both the primary cutting edge 108 and final trim edge 109 of such baffle may be of the same vertical height, and a simplified mounting may also be provided for the baffle as by providing a pair of vertically spaced mounting studs 110 on the partition 16' for tight frictional engagement by the inwardly facing turned ends of the baffle legs. A shield 111 adjacent the bottom of the spray chamber 14 prevents the spray from coming out the bottom when the container 6' is removed and the spray chamber is, for example, being flushed. The shield may be suitably notched as at 112 to permit extension of the delivery tube 56' therethrough into the spray chamber, and for return flow of the excess liquid to the container.

During use of the device, there may be occasions when it is desirable to vary the amount of paint being delivered to the spinner disc by the pump depending upon the type of paint being sprayed, its viscosity, etc. The spraying unit of the FIGS. 7–9 embodiment provides for variations in the amount of paint being supplied by the pump (not shown, but which corresponds to the pump 12 of the FIGS. 1–3 embodiment) by varying the length of the stroke of the pump rod 30' without varying the speed of the drive motor 15' so that the rate of rotation of the spinner disc may remain substantially constant. To effect such pump stroke variations, there is provided an adjustable connection 120 between the eccentric cam 19' and pump rod 30'. The connector member 121, like the connector member 21 of the previous embodiment, contains a horizontal slot 122 in which the eccentric cam 19' is received, whereby during rotation of the eccentric cam, the connector member and thus the pump rod connected thereto is caused to move up and down for reciprocating the pump rod. However, the pump rod 30', rather than being fixedly attached to the connector member 121, has a slidable connection therewith formed as by providing an arcuate flange 123 adjacent the lower edge of the connector member, and a yoke 124 attached to the upper end of the pump rod having a notch 125 therein in which the flange is slidably received.

The connector member 121 includes an arm portion 130, the outer end of which is pivotally connected to a lever 131 rotatably supported on a bushing 132 concentric with respect to the drive motor 15'. The lever 131 may be retained against the motor mounting plate 13' by a pair of screws 133 which are located radially outwardly of the bushing 132 so as not to interfere with the rotation of the lever but which have heads 134 that overlie the peripheral edge of the lever.

Figure 11:
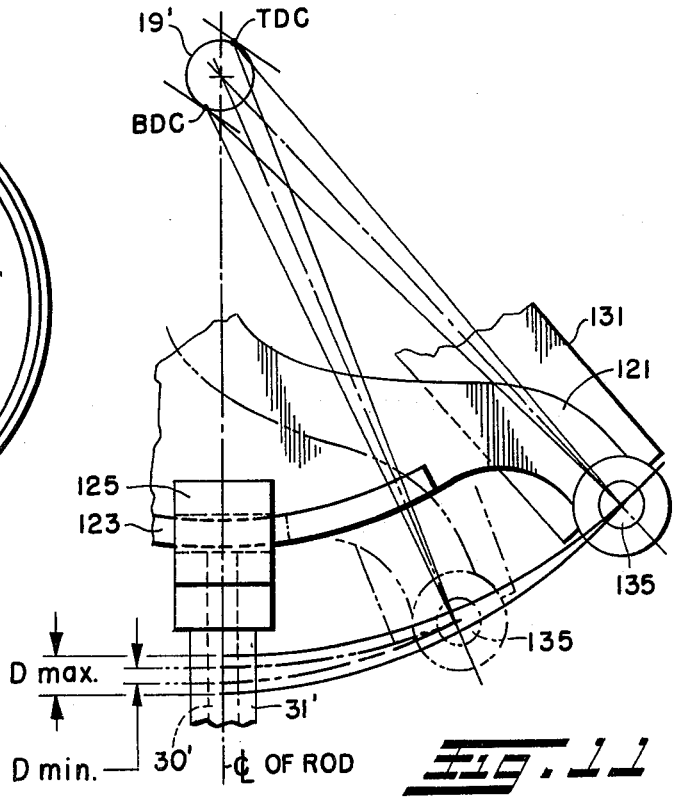
FIG. 11 is a schematic illustration showing the mechanism for varying the length of stroke of the pump piston.

As illustrated in FIGS. 8 and 9 and schematically shown in FIG. 11, the pivotal connection 135 between the connector member 121 and lever 131 is radially spaced from the axis of the drive shaft 18' and centerline of the pump rod 30', and such pivotal connection includes a protruding stem portion 136 extending through a slot 137 in the back wall 138 of the housing permitting movement of such pivot 135 toward and away from the centerline of the pump rod. As also apparent from the schematic illustration of FIG. 11, both the bottom dead center (BDC) and top dead center (TDC) points on the eccentric cam 19' are slightly off center with respect to the centerline of the pump rod respectively on opposite sides thereof. Because of such geometry, as the pivot 135 is moved closer to the centerline of the pump rod 30', the length of stroke of the pump rod decreases from the maximum displacement $D_{max}$ when the pivot 135 is in the outermost solid line position shown in FIG. 11 to the minimum displacement $D_{min}$ when the pivot 135 is in the innermost phantom line position shown in FIG. 11.

The location of both bottom dead center and top dead center of the eccentric cam 19' off center with respect to the centerline of the pump rod on opposite sides thereof is kept to a minimum to minimize rubbing. Sufficient clearance is provided between the pump rod 30' and mount tube 31' in which the pump rod is received to accommodate the angular displacement of the pump rod during reciprocation thereof which occurs during rotation of the eccentric cam 19' because of the pivotal action of the connector member 121 about the pivot 135. A guide spring 140 may be provided within the mount tube 31' intermediate the ends thereof as shown in FIG. 7 for guiding the pump rod 30' during such movement. Suitable detents 141 or the like may also be provided on the wall 138 of the housing to retain the lever 121 in any one of a plurality of different positions.

It will be appreciated from the above description that the various portable pump spraying devices of the present invention are of a relatively simple and reliable construction in which the pumping and spraying are interrelated by a common drive for optimum control. Moreover, the positioning of the spinner disc relative to the container and the straight through flow for the pumped liquid permits spraying virtually all kinds of paints and provides for easy access to the parts of the device for ease of cleaning and maintenance or repair, if required. The device also has the further advantage that when the trigger is released to shut the pump motor off, there is a relatively sharp cut-off of the fluid spray without the need for additional more expensive parts. The pump motor 15, being relatively small and low powered, has little inertia, whereby when it is shut off, it has a relatively short coasting period. Moreover, even though some liquid may continue to be pumped through the delivery tube during the coasting period, the motor slows down immediately, so that there is no longer sufficient pressure to direct a stream of liquid out the nozzle with sufficient velocity to shoot across the space between the nozzle and disc and impinge on the disc. Thus, any liquid that does emerge from the nozzle after release of the trigger will simply flow back down along the delivery tube into the container for recirculation.

The embodiments of the invention in which an exclusive property or privilege is claimed are defined as follows:

1. A portable pump spraying device comprising a container for the liquid to be sprayed, a housing removably connected to said container, said housing containing a spraying chamber with an egress slot therein, pump means for delivering liquid to said spraying chamber from said container, a vertically oriented disc in said spraying chamber, drive means for rotating said disc, and means for directing the liquid delivered to said spraying chamber by said pump means onto said vertically oriented disc, the rotation of said disc being operative by centrifugal force to impel a portion of the liquid directed thereon through said egress slot as a spray, and interceptor means within said spraying chamber to define the spray pattern angle and assist in returning excess liquid to said container for recirculation by said pump means, said egress slot being substantially vertical, including trailing and leading edges, and said interceptor means including a baffle positioned adjacent said trailing edge of said egress slot, said baffle extending both above and below said trailing edge and across the peripheral edge of said disc to trim the lower edge of the spray pattern and intercept the attenuated liquid in the region of said trailing edge of said egress slot for return to said container, thereby to keep liquid from dripping onto the external surfaces of said housing and disc adjacent the trailing edge of said slot, said interceptor means including a second baffle between the first baffle and said slot for finely trimming the lower edge of the spray pattern previously cut by said first baffle.

2. The pump spraying device of claim 1 wherein said interceptor means is of a generally U-shape having first and second legs defining said first and second baffles.

3. The pump spraying device of claim 1 wherein said second baffle extends to a lesser extent above the trailing edge of said slot than said first baffle.

4. A portable pump spraying device comprising a container for the liquid to be sprayed, a housing removably connected to said container, said housing containing a spraying chamber with an egress slot therein, pump means for delivering liquid to said spraying chamber from said container, a vertically oriented disc in said spraying chamber, drive means for rotating said disc, and means for directing the liquid delivered to said spraying chamber by said pump means onto said vertically oriented disc, the rotation of said disc being operative by centrifugal force to impel a portion of the liquid directed thereon through said egress slot as a spray, and interceptor means within said spraying chamber to define the spray pattern angle and assist in returning excess liquid to said container for recirculation by said pump means, said interceptor means including a baffle positioned adjacent said leading edge of said egress slot, said baffle having a generally transversely extending interceptor portion which projects from one side of said disc to the other adjacent the leading edge of said slot to intercept the liquid that is flung off said disc outwardly of said transversely extending interceptor portion for trimming the upper edge of the spray pattern, said baffle being generally fan shaped, including an angularly disposed upper leg portion behind said disc for collecting excess liquid in the upper portion of said spray chamber behind said disc and a vertically oriented leg portion extending around and downwardly below said drive means for directing the excess liquid back to the container.

5. A portable pump spraying device comprising a container for the liquid to be sprayed, a housing removably connected to said container, said housing containing a spraying chamber with an egress slot therein, pump means for delivering liquid to said spraying chamber from said container, a vertically oriented disc in said spraying chamber, drive means for rotating said disc, and means for directing the liquid delivered to said spraying chamber by said pump means onto said vertically oriented disc, the rotation of said disc being operative by centrifugal force to impel a portion of the liquid directed thereon through said egress slot as a spray, and interceptor means within said spraying chamber to define a generally vertically extending spray pattern angle and assist in returning excess liquid to said container for recirculation by said pump means, said interceptor means including a baffle positioned adjacent said leading edge of said egress slot, said baffle having a generally transversely extending interceptor portion which projects from one side of said disc to the other adjacent the leading edge of said slot to intercept the liquid that is flung off said disc outwardly of said transversely extending interceptor portion for trimming the upper edge of the spray pattern, and a downwardly extending portion adjacent one side of said disc extending around and downwardly below said drive means for collecting excess liquid in the upper portion of said spray chamber and directing the excess liquid back to the container.

6. A portable pump spraying device comprising a container for the liquid to be sprayed, a housing removably connected to said container, said housing containing a spraying chamber with an egress slot therein, pump means for delivering liquid to said spraying chamber from said container, a vertically oriented disc in said spraying chamber, drive means for rotating said disc, and means for directing the liquid delivered to said spraying chamber by said pump means onto said vertically oriented disc, the rotation of said disc being operative by centrifugal force to impel a portion of the liquid directed thereon through said egress slot as a spray, and interceptor means within said spraying chamber to define a generally vertically extending spray pattern angle and assist in returning excess liquid to said container for recirculation by said pump means, said interceptor means including baffle means positioned adjacent said leading edge of said egress slot on opposite sides of said disc, each said baffle means extending around and downwardly below said drive means for collecting excess liquid in the upper portion of said spray chamber and directing the excess liquid back to the container.

7. The pump spraying device of claim 6 wherein each said baffle means includes an upper leg portion extending at an angle adjacent the leading edge of said egress slot generally forwardly of said drive means, and a lower leg portion extending generally vertically downwardly from said upper leg portion forwardly of said drive means.

8. The pump spraying device of claim 7 wherein said housing includes a removable cover permitting access to the interior of said spraying chamber, one of said baffle means being mounted on said removable cover to facilitate assembly and disassembly of said one baffle means.

9. The pump spraying device of claim 7 wherein one of said baffle means has a generally transversely extending interceptor portion which projects from one side of said disc to the other adjacent the leading edge of said egress slot to intercept the liquid that is flowing off said disc outwardly of said transversely extending interceptor portion for trimming the upper edge of the spray pattern, said baffle means permitting limited tilting of said pump spraying device either forward or back as well as to either side during use as may be required for spraying at different angles without splatter.

10. The pump spraying device of claim 9 wherein said transversely extending interceptor portion has a notch therein into which the outer peripheral portion of said disc extends.

11. A portable pump spraying device comprising a container for the liquid to be sprayed, a housing removably connected to said container, said housing containing a spraying chamber with an egress slot therein, pump means for delivering liquid to said spraying chamber from said container, a vertically oriented disc in said spraying chamber, drive means for rotating said disc, and means for directing the liquid delivered to said spraying chamber by said pump means onto said vertically oriented disc, the rotation of said disc being operative by centrifugal force to impel a portion of the liquid directed thereon through said egress slot as a spray, said drive means including a motor positioned in a drive chamber in said housing, an output shaft extending from said motor into said spraying chamber, said disc being rotatably mounted on said output shaft, said pump means including means for converting the rotary motion of said output shaft and disc to reciprocal movement of a piston in said pump means, said piston being operative to withdraw liquid from said container during the suction stroke and deliver the withdrawn liquid through a delivery tube to said spraying chamber during the compression stroke, said delivery tube extending into said spraying chamber and terminating in axially spaced relation to said disc for directing the pumped liquid against one face of said disc, and means for varying the length of stroke of said piston to vary the amount of liquid being pumped by said pump means without varying the speed of said motor so that the rate of rotation of said disc remains substantially constant, said means for converting comprising an eccentric mounted on said output shaft in said drive chamber, and said means for varying the length of stroke of said piston comprising a connector member having a slot therein for receipt of said eccentric, said eccentric causing translating movement of said connector member during rotation of said eccentric, means mounting said connector member for pivotal movement about a pivot point radially spaced from said eccentric and the centerline of said piston, and means for moving said pivot point toward and away from the centerline of said piston, the bottom dead center and top dead center of said eccentric being slightly off center with respect to the centerline of said piston on opposite sides thereof, whereby the closer said pivot point is to said centerline the shorter the stroke of said piston and vice versa.

12. The pump spraying device of claim 11 wherein said means mounting said connector member for pivotal movement comprises a lever mounted for rotational movement about the axis of said output shaft toward and away from the centerline of said piston, said pivot point being between said connector member and lever, whereby rotation of said lever causes movement of said pivot point therewith.

13. The pump spraying device of claim 12 further comprising a sliding connection between said piston and connector member permitting movement of said pivot point toward and away from the centerline of said piston during pivotal movement of said lever.

14. The pump spraying device of claim 13 wherein said sliding connection comprises a radial flange on said connector member, and a yoke on said piston having a slot therein for sliding engagement of said flange therein.

15. A portable pump spraying device comprising a container for the liquid to be sprayed, a housing removably connected to said container, said housing containing a spraying chamber with an egress slot therein, pump means for delivering liquid to said spraying chamber from said container, a vertically oriented disc in said spraying chamber, drive means for rotating said disc, and means for directing the liquid delivered to said spraying chamber by said pump means onto said vertically oriented disc, the rotation of said disc being operative by centrifugal force to impel a portion of the liquid directed thereon through said egress slot as a spray, and interceptor means within said spraying chamber to define a generally vertically extending spray pattern angle and assist in returning excess liquid to said container for recirculation by said pump means, said interceptor means including baffle means positioned adjacent said leading edge of said egress slot, said baffle means having an interceptor portion which projects from one side of said disc to the other adjacent the leading edge of said slot to intercept the liquid that is flung off said disc outwardly of said interceptor portion for trimming the upper edge of the spray pattern, and which also extends downwardly adjacent one side of said disc for collecting excess liquid in the upper portion of said spray chamber and directing the excess liquid back to the container.

16. The pump spraying device of claim 15 wherein said interceptor means includes additional baffle means positioned adjacent said leading edge of said egress slot on the other side of said disc for collecting excess liquid in the upper portion of said spray chamber and directing such excess liquid back to the container.

17. The pump spraying device of claim 15 wherein said interceptor means also includes additional baffle means extending both above and below said trailing edge of said egress slot and across the peripheral edge of said disc to trim the lower edge of the spray pattern and intercept the attenuated liquid in the region of said trailing edge of said egress slot for return to said container, thereby to keep liquid from dripping onto the external surfaces of said housing and disc adjacent the trailing edge of said egress slot.

18. A portable pump paint spraying device comprising a container for the paint to be sprayed, a housing removably connected to said container, said housing containing a spraying chamber with a vertically oriented egress slot therein, pump means for delivering paint to said spraying chamber from said container, a vertically oriented disc in said spraying chamber, drive means for rotating said disc, and means for directing the paint delivered to said spraying chamber by said pump means onto said vertically oriented disc, the rotation of said disc being operative by centrifugal force to impel a portion of the paint directed thereon through said egress slot as a spray, said drive means including an electric motor positioned in a drive chamber in said housing, and an output shaft extending from said motor into said spraying chamber, said disc being rotatably mounted on said output shaft, said pump means also being driven by said output shaft for delivering paint through a delivery tube to said spraying chamber, said delivery tube extending into said spraying chamber and terminating in axially spaced relation to said disc for directing the pumped paint against one face of said disc, and interceptor means within said spraying chamber to define a generally vertically extending spray pattern angle and assist in returning excess paint to said container for recirculation by said pump means, said interceptor means including baffle means positioned adjacent said leading edge of said egress slot, said baffle means having an interceptor portion which projects from one side of said disc to the other adjacent the leading edge of said slot to intercept the paint that is flung off said disc outwardly of said interceptor portion for trimming the upper edge of the spray pattern, and which also extends downwardly adjacent one side of said disc for collecting excess paint in the upper portion of said spray chamber and directing the excess paint back to the container.

19. The pump spraying device of claim 18 wherein said disc is generally conically shaped and the paint is directed against the apex area of said conically shaped disc.

20. The pump spraying device of claim 18 wherein said disc is substantially flat, and there are two of said delivery tubes extending into said spraying chamber and terminating in axially spaced relation to opposite sides of said disc for directing paint to be sprayed from said pump means against both sides of said disc.

21. The pump spraying device of claim 18 wherein said pump means includes means for converting the rotary motion of said output shaft to reciprocal movement of a piston in said pump means, said piston being operative to withdraw paint from said container during the suction stroke and to deliver the withdrawn paint through said delivery tube during the compression stroke, said means for converting comprising an eccentric mounted on said output shaft, said piston being reciprocally driven by rotation of said eccentric, and a connector member for connecting said piston to said eccentric, said connector member having a horizontal slot therein for effecting vertical reciprocal movement of said connector member and thus said piston but not horizontal movement, and fixed guide means adjacent opposite sides of said connector member for guiding said connector member during such vertical reciprocal movement.

22. The pump spraying device of claim 21 further comprising means for varying the length of stroke of said piston to vary the amount of paint being pumped by said pump means without varying the speed of said motor so that the rate of rotation of said disc remains substantially constant.

23. A portable pump paint spraying device comprising a container for the paint to be sprayed, a housing removably connected to said container, said housing containing a spraying chamber with an egress slot therein, pump means for delivering paint to said spraying chamber from said container, a vertically oriented disc in said spraying chamber, means for directing the paint delivered to said spraying chamber by said pump means onto said disc, and drive means for simultaneously rotating said disc and driving said pump means, the rotation of said disc being operative by centrifugal force to impel a portion of the paint directed thereon through said egress slot as a spray, said drive means including an electric motor means positioned in a drive chamber in said housing, and an output shaft extending from said motor means into said spraying chamber, said disc being rotatably mounted on said output shaft, an eccentric mounted on said output shaft, a piston for said pump means reciprocally driven by rotation of said eccentric, said piston being operative to withdraw paint from said container during the suction stroke and deliver the withdrawn paint through a delivery tube to said spraying chamber during the compression stroke, said delivery tube extending into said spraying chamber and terminating in a nozzle in axially spaced relation to said disc for directing the pumped paint against one face of said disc, said pump means including a passage through which the paint is pumped for discharge into said delivery tube, said passage and delivery tube defining a substantially straight flow path from said container for the paint to said spraying chamber to minimize power requirements and facilitate pumping of paints of different types and viscosities, said electric motor means being a relatively small, low power electric motor having little inertia, the axial spacing between said nozzle and disc being such that when the power to said motor means is interrupted, the pressure of said pump means immediately drops off such that there is no longer sufficient pressure to direct a stream of paint out said nozzle with sufficient velocity to shoot across the space between said nozzle and disc and impinge upon said disc when said disc is substantially vertically oriented.

24. The pump spraying device of claim 23 wherein said piston is in the form of a long rod slidably received in a sleeve extending from said housing for extension into said container to a position adjacent the bottom of said container, one end of said rod being connected to said eccentric and the other end of said rod being received in a pumping chamber, said pumping chamber including check valve means for admitting paint into said pumping chamber during the suction stroke of said piston and discharging paint out into said delivery tube during the compression stroke of said piston, and means for varying the length of stroke of said piston to vary the amount of paint being pumped by said pump means without varying the speed of said motor means and thus the speed of rotation of said disc driven thereby.

25. The pump spraying device of claim 23 further comprising interceptor means within said spraying chamber to define a generally vertically extending spray pattern angle and assist in returning excess paint to said container for recirculation by said pump means, said egress slot being substantially vertical, including trailing and leading edges, and said interceptor means including baffle means positioned adjacent said trailing edge of said egress slot, said baffle means extending across the peripheral edge of said disc to trim the lower edge of the spray pattern and intercept the attenuated paint in the region of said trailing edge of said egress slot for return to said container, thereby to keep paint from dripping onto the external surfaces of said housing and disc adjacent the trailing edge of said egress slot, and additional baffle means positioned adjacent said leading edge of said egress slot, said additional baffle means having an interceptor portion which projects from one side of said disc to the other adjacent the leading edge of said slot to intercept the paint that is flung off said disc outwardly of said interceptor portion for trimming the upper edge of the spray pattern, and which also extends downwardly adjacent one side of said disc for collecting excess paint in the upper portion of said spray chamber and directing the excess paint back to the container.

* * * * *